United States Patent [19]

Kusayama

[11] 4,447,936

[45] May 15, 1984

[54] SLIDE FASTENER WITH SEPARABLE BOTTOM END STOP

[75] Inventor: Masahiro Kusayama, Kurobe, Japan

[73] Assignee: Yoshida Kogyo K K, Tokyo, Japan

[21] Appl. No.: 310,380

[22] Filed: Oct. 13, 1981

[30] Foreign Application Priority Data

Nov. 1, 1980 [JP] Japan ..... 55-156533

[51] Int. Cl.[3] ..... A44B 19/36

[52] U.S. Cl. ..... 24/433

[58] Field of Search ..... 24/205.11 R, 205.11 F, 24/205.11 L, 205.16 R; 33/180 R, 185 R; 116/200, 205, DIG. 17

[56] References Cited

U.S. PATENT DOCUMENTS

| | | | |
|---|---|---|---|
| 2,319,874 | 5/1943 | Marinsky | 24/205.11 R |
| 3,104,438 | 9/1963 | Scarpini | 24/205.11 F |
| 3,280,437 | 10/1966 | Schwendt | 24/205.11 F |
| 3,892,017 | 7/1975 | Watson | 24/205.11 F |
| 4,139,927 | 2/1979 | Heimberger | 24/205.11 F |
| 4,301,546 | 11/1981 | de Polo | 2/243 B |

*Primary Examiner*—John J. Wilson
*Assistant Examiner*—David I. Tarnoff
*Attorney, Agent, or Firm*—Bucknam and Archer

[57] ABSTRACT

A slide fastener has a separable bottom end stop including a pair of separate members mounted on opposite marginal beads of a pair of stringers having interlocking fastener elements carried on the beads. The bottom end stop members are disposed adjacent to the lowermost fastener element for being interlocked with one another. A pair of register marks is disposed one on each of the stringers and is spaced from the bottom stop members to such an extent that the register marks are disposed below the rear end of the slider at the beginning of interlocking of the bottom stop members within the slider upon threading of the pair of stringers through the slider. The register marks are used as a reference to place the separate bottom stop members in correct alignment one with another for proper interlocking.

6 Claims, 7 Drawing Figures

SLIDE FASTENER WITH SEPARABLE BOTTOM END STOP

BACKGROUND OF THE INVENTION

1. Field of the Invention

The present invention relates to slide fasteners, and more particularly to a slide fastener having a separable bottom end stop. The bottom end stop includes at least a pair of separate members combinable into a unified body upon threading of a pair of stringers through a slider.

2. Prior Art

U.S. Pat. No. 3,104,438, issued Sept. 24, 1963 to Scarpini, discloses a slide fastener having a separable bottom end stop. The bottom end stop comprises at least a pair of separate members mounted on opposite marginal beads of a pair of stringers and combinable into a unified body upon threading of the pair of stringers through a slider. The interlocking of these separate bottom stop members takes place totally within the slider, during which time their location cannot come into sight. It is therefore very difficult for a layman to place the separate bottom stop members in correct alignment one with another within the slider for proper interlocking. Further, if the slider is forcibly threaded onto the pair of stringers with the separate bottom stop members interlocked incorrectly, it would result in an totally inoperative slide fastener.

SUMMARY OF TEH INVENTION

According to the present invention, a slide fastener has a separable bottom end stop including a pair of separate members mounted on opposite marginal beads of a pair of stringers having interlocking fastener elements carried on the beads. The separate bottom stop members are disposed adjacent to the lowermost fastener element for being interlocked with one another. The slide fastener also has a pair of register marks disposed one on each of the stringers and spaced from the separate bottom stop members to such an extent that the register marks are disposed below the rear end of a slider at the beginning of interlocking of the separate bottom stop members within the slider upon threading of the pair of stringers through the slider. The pair of register marks is aligned with one another transversely of the stringers when the separate bottom stop members are registered with one another for proper interlocking; the marks are accordingly used as a reference to adjust the bottom stop members one to another for proper interlocking.

It is an object of the invention to provide a slide fastener with a separable bottom end stop, in which separate members of the bottom end stop can be placed in correct alignment one with another within a slider, for proper interlocking, with maximum ease, requiring no well-experienced workman.

Other objects and advantages will appear from the following description, when considered in connection with the accompanying drawings, and the novel features will be particularly pointed out in the appended claims.

BRIEF DESCRIPTION OF THE DRAWINGS

Like reference numerals designate the same or similar parts throughout the figures.

DETAILED DESCRIPTION

Figure 1:
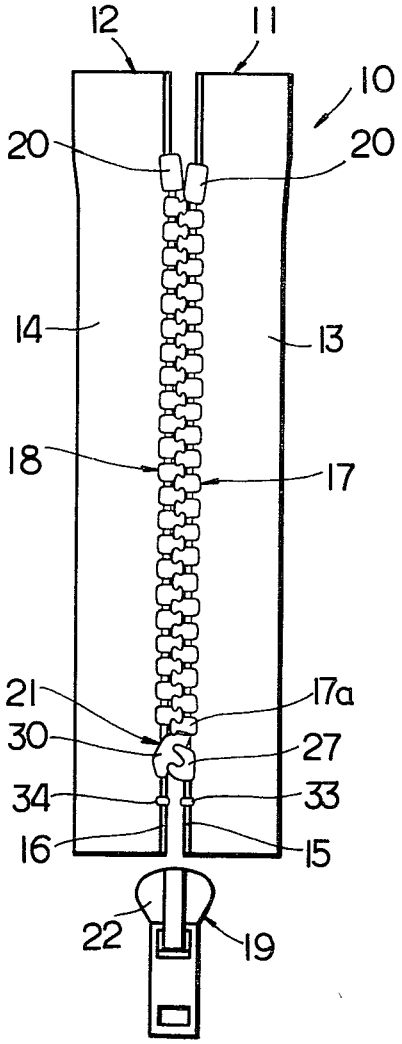
FIG. 1 is a plan view of a slide fastener having a separable bottom end stop, employing the present invention.

As shown in FIG. 1, a slide fastener 10 comprises a pair of stringers 11,12 including a pair of tapes 13,14 having a pair of first and second beads 15,16 extending along their respective inner longitudinal edges, and a pair of rows of interlocking fastener elements 17,18 mounted on and along the first and second beads 15,16, respectively. A slider 19 is adapted to be threaded onto the pair of stringers 11,12 for interlocking and disengaging the fastener elements 17,18 in response to opposite directions of movement along the pair of stringers 11,12 to open and close the slide fastener 10. A pair of top end stops 20,20 is mounted on the beads 15,16 at the top end of the fastener element rows 17,18 to limit upward or forward movement of the slider 19. At the bottom end of the fastener element rows 17,18, a separable bottom end stop 21, which is described below in detail, is mounted to limit downward or backward movement of the slider 19.

Figure 2:
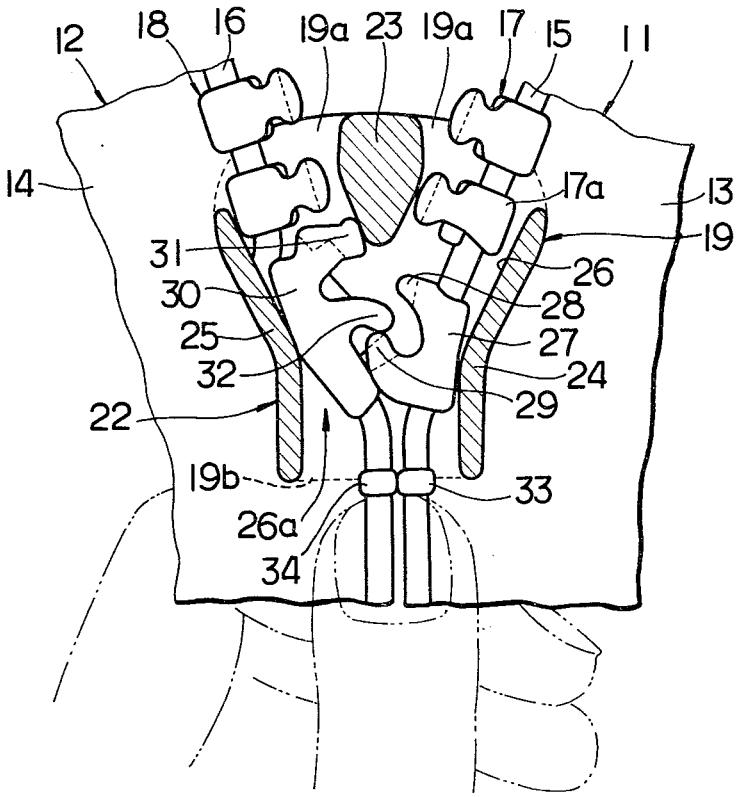
FIG. 2 is an enlarged, fragmentary cross-sectional view of the slide fastener, showing the relative position of the bottom end stop and a pair of register marks.

As shown in FIG. 2, the slider 19 includes a slider body 22 having a diamond or wedge-shaped neck portion 23 disposed centrally at a flared front end **19*a* thereof and a pair of first and second flaring flanges 24,25 disposed along opposite sides of the slider 19 to define with the diamond 23 a Y-shaped guide channel 26 for passage of the separable bottom end stop 21 (as described below) as well as the fastener element rows 17,18**.

Figure 3:
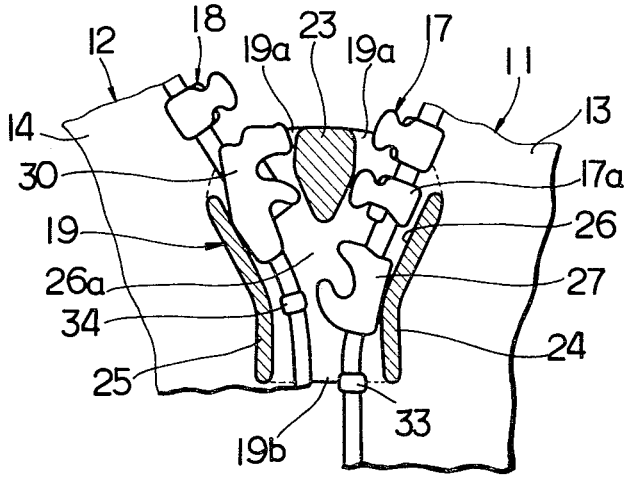
FIG. 3 is a view similar to FIG. 2, showing the manner in which separate members of the bottom end stop are registered for correct interlocking.

The bottom end stop 21, as better shown in FIGS. 2 and 3, comprises a first member 27 mounted on the first bead 15 in spaced relation to the lowermost fastener element **17*a* and having a pair of spaced upper and lower protrusions 28,29 extending obliquely upwardly toward the second bead 16. The bottom end stop 21 also comprises a second member 30 mounted on the second bead 16 opposite to the first member 27 and having a pair of upper and lower tongues 31,32 extending obliquely downwardly toward the first bead 15. As the first and second members 27,30 are interlocked or joined with one another into a unified body (FIG. 1) as described below, the upper and lower tongues 31,32 are fixedly trapped, respectively, between the lowermost fastener element 17*a* and the upper protrusion 28 and between the upper and lower protrusions 28,29. The bottom end stop 21 having been thus assembled is prevented from being accidentally disassembled due to severe lateral forces tending to pull the stringers 11,12 apart from one another. Unobstructed movement of the slider 19 is insured all the way between the second member 30 of the bottom end stop 21 and the top end stops 20,20**.

However, the interlocking of the first and second bottom stop members 27,30 takes place totally within the slider 19, during which time their location cannot come into sight. The first and second members 27,30 being to interengage with one another when they reach a throat portion 26*a* of the guide channel 26, as shown in FIG. 2. It has been therefore very difficult to place the first and second members 27,30 in correct alignment one with another within the slider 19 for proper interlocking. To solve this problem, a pair of register marks 33,34 is mounted on the first and second beads 15,16, respectively, and is spaced from the first and second members 27,30 to such an extent that the register marks 33,34 are disposed below a rear end 19*b* of the slider 19 at the beginning of interlocking of the first and second members 27,30 within the slider 19 upon threading of the pair of stringers 11,12 through the slider 19. Relative position of the register marks 33,34 is such that they are aligned with one another transversely of the stringers 11,12 when the first and second members 27,30 are registered with one another for correct interlocking.

Preferably, the fastener elements 17,18, the top end stops 20,20, the bottom end stop members 27,30 and the register marks 33,34 are made of thermoplastic synthetic resin and are injection-molded onto the beads 15,16 simultaneously at the same stage of manufacture.

In use, the stringer 11 carrying the first member 27 of the bottom end stop 21 is threaded through the slider 19 from the flared front end 19*a* thereof until the first member 27 reaches the throat 26*a* of the guide channel 26, as shown in FIG. 3, at which time the register mark 33 is disposed adjacent to the rear end 19*b* of the slider 19. With the register mark 33 maintained in the position of FIG. 3, the companion stringer 12 carrying the second member 30 is then threaded through the slider 19 until the register mark 34 is aligned with the register mark 33, at which time the first and second members 27,30 are in correct alignment one with another for proper interlocking, as shown in FIG. 2. Finally, the pair of stringers 11,12 is pulled together downwardly until the slider 9 is moved past the first and second members 27,30 and thence onto the pair of interlocking fastener elements 17,18. As a result, proper interlocking of the first and second members 27,30 and thus easy and accurate threading of the stringers 11,12 through the slider 19 have been completed.

Figure 4:
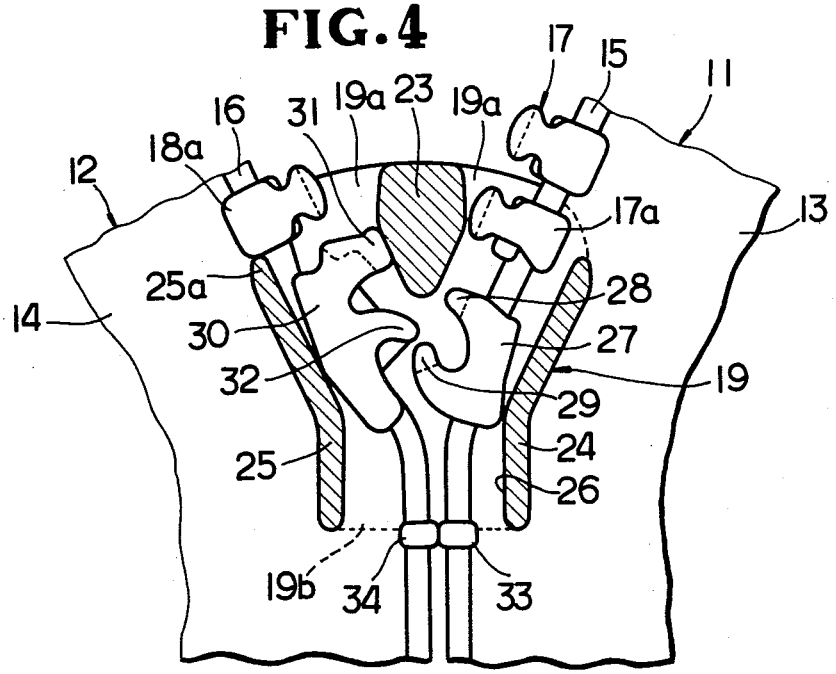
FIGS. 4 and 5 are views similar to FIGS. 2 and 3, but showing a second embodiment.
Figure 5:
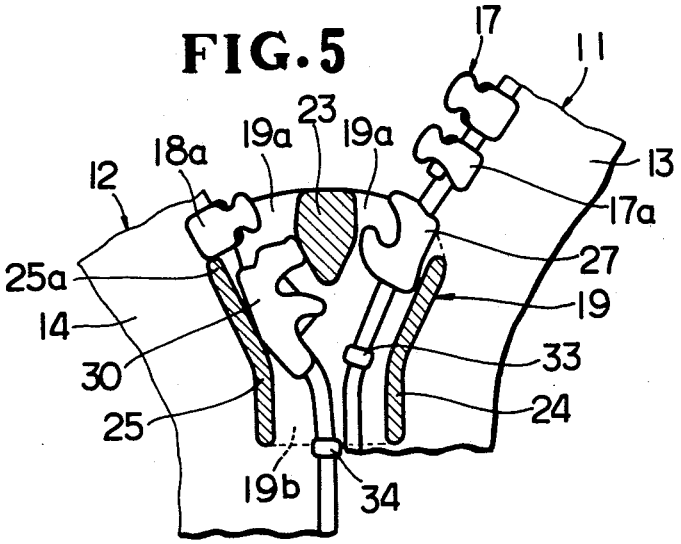

According to a second embodiment shown in FIGS. 4 and 5, the register mark 34 is so spaced from the second member 30 that the register mark 34 is disposed adjacent to the rear end 19*b* of the slider 19 when the fastener element 18*a* adjacent to the second member 30 is in engagement with a front end 25*a* of one of the flanges 24,25. The register mark 33 is so spaced from the first member 27 that the latter is registered with the second member 30, for correct interlocking, when the register mark 33 is aligned with the register mark 34 at the rear end 19*b* of the slider 19. In use, the stringer 12 carrying the second member 30 is threaded through the slider 19 from the flared front end 19*a* thereof until the fastener element 18*a* comes in engagement with the front end 25*a* of one of the flanges 24,25, at which time the register mark 34 is disposed adjacent to the rear end 19*b* of the slider 19. With the register mark 34 maintained in the position of FIG. 5, the companion stringer 11 carrying the first member 27 is then threaded through the slider 19 until the register mark 33 is aligned with the register mark 34, at which time the first member 27 is registered with the second member 30 for correct interlocking. After that, the pair of stringers 11,12 is pulled together downwardly until the slider 19 is moved past the first and second members 27,30 and thence onto the pair of interlocking fastener elements 17,18. As a result, proper interlocking of the first and second members 27,30 and thus easy and accurate threading of the stringers 11,12 through the slider 19 have been completed.

In the embodiments of FIGS. 1 through 5, each of the register marks 33,34 comprises a lug.

Figure 6:
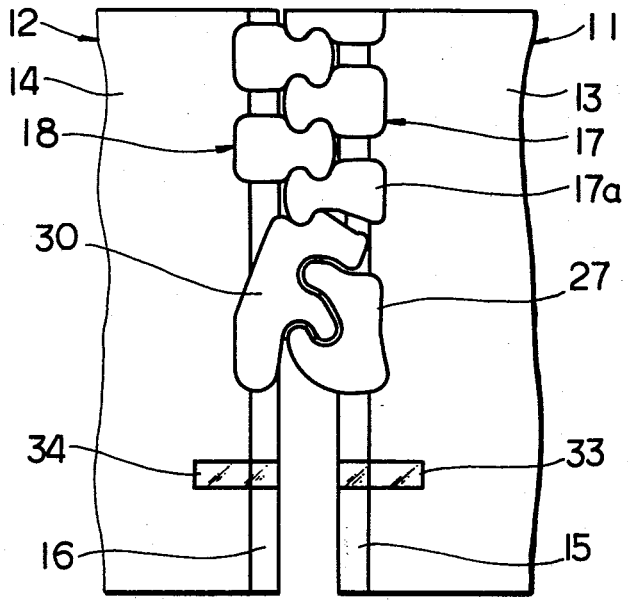
FIG. 6 is a fragmentary plan view of a slide fastener incorporating a pair of modified register marks according to a third embodiment.

FIG. 6 shows a third embodiment in which each of the register marks 33,34 comprises a recess extending transversely of a respective one of the stringers 11,12 and having a lustrous surface. Such lustrous recesses 33,34 may be formed by pringing or ultrasonic processing.

Figure 7:
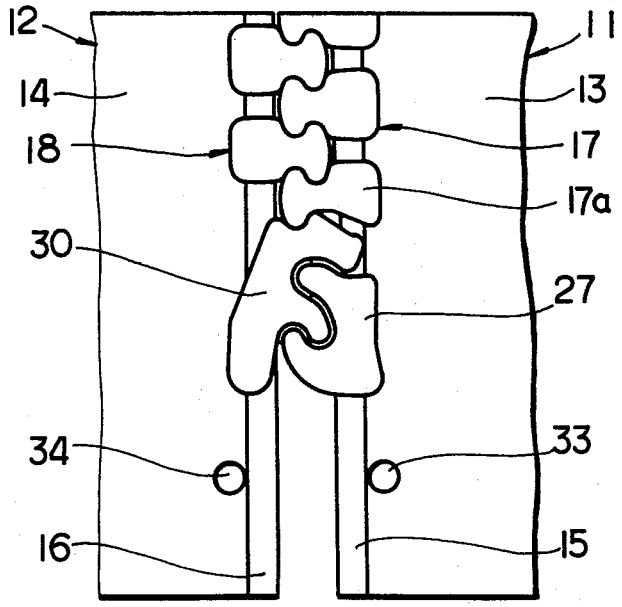
FIG. 7 is a view similar to FIG. 6, but showing a fourth embodiment.

FIG. 7 shows a fourth embodiment in which each of the register marks 33,34 comprises an opening in a respective one of the stringer 11,12.

It will be understood that various changes in the details, material, and arrangements of parts, which have been herein described and illustrated in order to explain the nature of the invention, may be made by those skilled in the art within the principle and scope of the invention as expressed in the appended claims.

What is claimed is:

1. A slide fastener comprising:

(a) a pair of stringers having interlocking fastener elements carried on a pair of first and second marginal beads thereof;

(b) a slider cooperable with said fastener elements to interlock and to disengage them in response to opposite directions of movement along said pair of stringers, said slider having a pair of flaring flanges;

(c) a separable bottom end stop including a pair of first and second members mounted on said first and second beads, respectively, adjacent to the lowermost fastener element for being interlocked with one another; and (d) a pair of register marks disposed one on each of said pair of stringers and spaced from said first and second members to such an extent that said register marks are disposed below a rear end of said slider at the beginning of interlocking of said first and second members within said slider upon threading of said pair of stringers through said slider, said register marks being aligned with one another transversely of said stringers when said first and second members are registered with one another for correct interlocking, said register marks being so spaced from said first and second members that said register marks are aligned with one another and with the rear end of said slider only after said first member is threaded through said slider until it reaches the correct position to interlock with said second member after said second member has been threaded through said slider to a correct position for interlocking with said first member.

2. A slide fastener according to claim 1, one of said register marks being so spaced from a corresponding one of said first and second members that said one register mark is disposed adjacent to the rear end of said slider when one of said fastener elements adjacent to said one of said first and second members is in engagement with a front end of one of said flanges.

3. A slide fastener according to claim 1, each of said register marks comprising a lug mounted on a respective one of said beads.

4. A slide fastener according to claim 3, said lug being injection-molded of thermoplastic synthetic resin.

5. A slide fastener according to claim 1, each of said register marks comprising an opening in a respective one of said stringers.

6. A slide fastener according to claim 1, in which each of said register marks comprises a recess extending transversely of a respective one of said stringers and having a lustrous surface.

* * * * *